United States Patent [19]

Holder et al.

[11] 4,454,376

[45] Jun. 12, 1984

[54] IN-LINE ELECTRICAL WIRE CONNECTOR

[76] Inventors: H. Dennis Holder, 16052 Wedgworth Dr., Hacienda Heights, Calif. 91745; Herb L. Goodman, 17321 Av. de la Herradura, Pacific Palisades, Calif. 90272

[21] Appl. No.: 448,974

[22] Filed: Dec. 13, 1982

[51] Int. Cl.[3] ..... H01R 4/00

[52] U.S. Cl. ..... 174/87; 174/84 S; 174/88 S; 339/205; 339/248 S; 339/249 A; 403/43

[58] Field of Search ..... 174/84 S, 87, 88 S; 339/205, 248 R, 248 S, 249 R, 249 A; 403/43, 48, 281

[56] References Cited

U.S. PATENT DOCUMENTS

| | | | |
|---|---|---|---|
| 457,865 | 8/1891 | Manson | 174/84 S |
| 1,657,253 | 1/1928 | Fortin | 174/87 |
| 2,470,423 | 5/1949 | Alford | 174/84 S |
| 2,772,323 | 11/1956 | Smith | 174/87 |
| 2,825,750 | 3/1958 | Stockwell | 174/87 |
| 3,206,833 | 9/1965 | Yonkers | 174/87 |
| 3,716,653 | 2/1973 | Willmarth | 174/87 |

*Primary Examiner*—J. V. Truhe
*Assistant Examiner*—Morris H. Nimmo
*Attorney, Agent, or Firm*—Bruce L. Birchard

[57] ABSTRACT

A connector for in-line electrical wires of the same or differing gauges in which an insulating casing envelopes a continuous, wire thread which tapers from each end of the casing towards the middle of the casing and the direction of the thread is right-handed from one end of the casing to the center of the casing and left-handed from the remaining end of the casing towards the center of the casing thus providing an easily applied, low cost connector and one which has minimum insertion resistance and maximum reliability.

10 Claims, 4 Drawing Figures

IN-LINE ELECTRICAL WIRE CONNECTOR

BACKGROUND OF THE INVENTION

1. Field of the Invention

This invention relates to electrical connectors and, more specifically to in-line electrical connectors.

2. Background of the Invention

In the distant past the joining of electrical conductors invariably involved twisting the two or more conductors together and soldering them. Names like "Western Union connection" and others were adopted and well known amongst electricians and hobbyists. There followed the "wire nuts" which comprised a plastic outer shell and a single, un-directionally threaded insert. To use this connector the conductors were laid, or held, with their exposed ends in the same direction, twisting the ends together and applying the wire nut to the intertwined conductors. Twisting the wire nut in a clockwise direction would draw the ends of the conductors into tight contact with each other and with the conductive thread in the nut, forming a satisfactory electrical connection. The problem with the wire nuts of the prior art was that the joint which they formed was, overall, bulky and in many instances very difficult to effect. Also, the radical change in direction required of the conductor made the use of the wire nut difficult if one of the conductors came from around a corner, or the like.

Therefore, it is an object of this invention to provide a wire connector that overcomes the problems and disadvantages of prior art devices.

It is a further object of this invention to provide a simple, low cost wire connector which is easy to apply and effects an electrically low resistance and mechanically strong inter-wire connection.

BRIEF DESCRIPTION OF THE PREFERRED IMBODIMENTS

The present invention can best be understood by referring to the description which follows and taking it in conjunction with the accompanying drawings, in which.

DETAILED DESCRIPTION OF THE PREFERRED EMBODIMENTS

Figure 1:
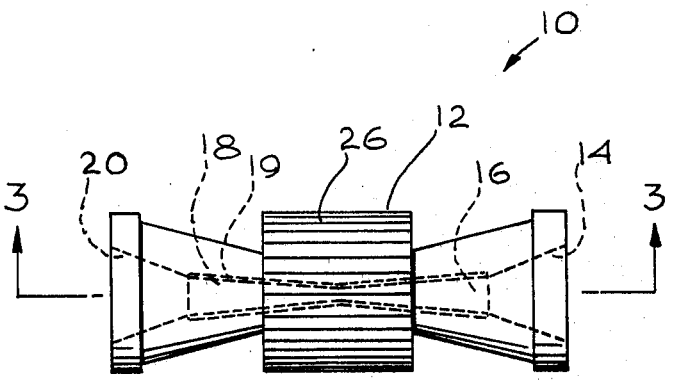
FIG. 1 is a side, elevational view of an electrical connector according to the present invention.
Figure 2:
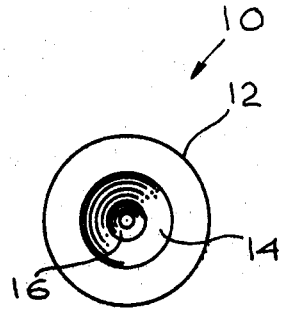
FIG. 2 is an end view of the connector of FIG. 1.
Figure 3:
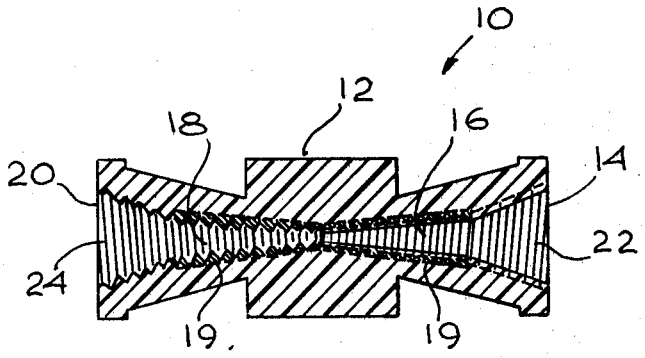
FIG. 3 is a cross sectional view taken along the line 3—3 in FIG. 1.

In FIGS. 1, 2 and 3 connector 10 includes an electrically insulative plastic shell 12, which is generally cylindrical and has a series of coaxial, tapered, or frustro-conical openings 14, 16, 18 and 20, therethrough. Embedded in the bounding surface of frustro-conical surfaces 16 and 18 but exposed for electrical contact on its inner surface is a continuous, conductive metal thread-wire 19 wound in a right-handed fashion in opening 16 and in a left-handed fashion in opening 18. The point of reversal in wire-winding direction is, generally, at the center of shell 12 where openings 16 and 18 join. The thread-wire has spring-like properties.

As can be seen in FIG. 2, openings 14 and 20 have threaded walls 22 and 24, respectively, without electrical conductivity. These regions can be considered feed-in or starter regions for the conductors to be joined.

A knurled grip-portion 26 is provided, centrally, in shell 12 to permit a firm grip of connector 10.

After any insulation has been removed from each of two wires one is inserted as far as possible in opening 20 and the other is inserted as far as possible in opening 14. Knurled region 26 is then gripped and shell 12 is turned in the direction in which the wires are drawn into shell 12. This process is continued until both wires are firmly engaged by continuous thread wire 19. The taper of openings 16 and 18 and, hence, the taper of frustro-conically wound thread-wire 19 must be gradual to assure extensive contact between thread-wire 19 and the wires being joined, thus ensuring good mechanical strength and good electrical conductivity therebetween.

Figure 4:
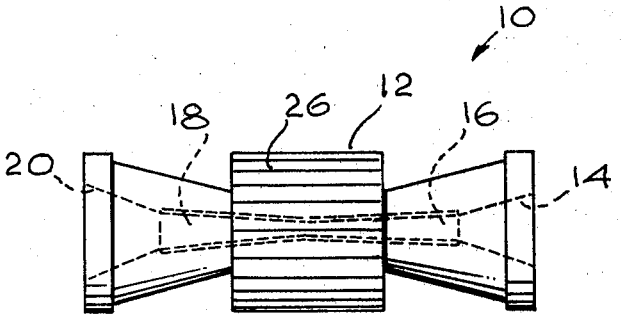
FIG. 4 is a side elevational view of a modification of the connector of FIG. 1.

If the wires are of significantly different gauges one set of openings, such as openings 14 and 16, may be of lesser diameter than the other set of openings, such as openings 18, 20. This combination is shown in FIG. 4. Of course, each opening combination can accommodate a broad range of gauges because of the tapered nature of each such opening combination. However, for maximum mechanical strength and electrical conductivity, different sized opening combinations may be required.

Thread wire 19 may not be circular in cross-section but may have a sharpened or triangular cross-section in its area exposed in openings 16 and 18. Such an edge would permit the threadwire to grip the inserted conductors better.

While particular embodiments have been shown and described, it will be apparent to those skilled in the art that variations and modifications may be made without departing from the true spirit and scope of this invention. It is the purpose of the appended claims to cover all such variations and modifications.

We claim:

1. A connector for electrical conductors including:

a unitary shell of electrically non-conducting material and having a first end, a second end and a center portion;

said unitary shell having first and second frustro-conically shaped bores therein joined at their narrow ends in said center portion of said shell, said bores having an axis;

a continuous wire thread fixedly supported along the surfaces of said first and second bores and being coaxial with said bores, whereby said continuous wire thread has first and second conductor-engaging frustro-conical sections each of substantially the same taper as its respective adjoining bore;

said first frustro-conical section of said wire thread being wound in a left-handed manner, said second frustro-conical section of said wire thread being wound in a right-handed manner.

2. Apparatus according to claim 1 in which said shell has a third frustro-conical bore between said first end and said first frustro-conical bore and a fourth frustro-conical bore between said second end and said second frustro-conical bore.

3. Apparatus according to claim 2 in which said third and fourth frustro-conical bore have non-conductive threads therein of opposite pitch, one to the other.

4. Apparatus according to claim 1 which said shell includes, in addition, a knurled outer portion proximate to said center portion.

5. Apparatus according to claim 1 in which said first and second bores and said third and fourth bores are of equal size, respectively.

6. Apparatus according to claim 1 in which said first and second bores and said third and fourth bores are of different sizes, respectively.

7. Apparatus according to claim 3 in which said non-conductive threads in said third frustro-conical bore are of a left-handed pitch and said non-conductive threads of said fourth frustro-conical bore are of a righthanded pitch.

8. Apparatus according to claim 1 in which said continuous wire-thread is embedded in the inner surface of said shell formed by said first and second bores.

9. Apparatus according to claim 1 in which said thread-wire is resilient.

10. Apparatus according to claim 1 in which said continuous thread-wire has spring-like characteristics.

* * * * *